US005228108A

United States Patent [19]

Motev et al.

[11] Patent Number: 5,228,108

[45] Date of Patent: Jul. 13, 1993

[54] RESIN CURING APPARATUS AND METHOD UTILIZING INFRARED LAMP AND BLOWER CONTROL MEANS

[75] Inventors: Phil Motev, Deerfield; Rick L. Fuqua, Chicago, both of Ill.

[73] Assignee: Advance Process Supply Company, Chicago, Ill.

[21] Appl. No.: 810,516

[22] Filed: Dec. 18, 1991

Related U.S. Application Data

[63] Continuation of Ser. No. 592,185, Oct. 3, 1990, abandoned.

[51] Int. Cl.[5] ..... B41F 15/10; F26B 3/30

[52] U.S. Cl. ..... 392/412; 392/415; 34/1 W; 34/48; 101/115; 101/114

[58] Field of Search ..... 392/412–418; 219/388, 492; 34/4, 48, 39, 41, 62, 1 W, 1 BB; 101/115, 114, 424.1, 416.1, 126, 129

[56] References Cited

U.S. PATENT DOCUMENTS

| | | | |
|---|---|---|---|
| 3,465,204 | 9/1969 | Michalski | 315/117 |
| 3,854,398 | 12/1974 | Martin | 101/126 |
| 3,894,343 | 7/1975 | Pray et al. | 392/412 |
| 4,032,817 | 6/1977 | Richmond | 392/412 |
| 4,169,007 | 9/1979 | Pray | 34/4 |
| 4,202,112 | 5/1980 | von der Eltz et al. | 34/4 |
| 4,474,109 | 10/1984 | Yara | 101/424.1 |
| 4,526,101 | 7/1985 | Ericsson | 34/4 |
| 4,545,131 | 10/1985 | Ericsson | 34/4 |
| 4,773,167 | 9/1988 | Jacobi, Jr. | 34/4 |
| 4,783,908 | 11/1988 | Pabst | 34/4 |
| 5,050,232 | 9/1991 | Bergman et al. | 392/412 |

*Primary Examiner*—Bruce A. Reynolds
*Assistant Examiner*—John A. Jeffery
*Attorney, Agent, or Firm*—Fitchh, Even, Tabin & Flannery

[57] ABSTRACT

A portable resin curing apparatus is used for curing or drying materials printed on a screen press which has rotatable platens carrying screen printed sheets from a printing station to a curing station. The portable curing apparatus is located and the curing station has electrical resistance heating elements alternating between low voltage and high voltage in conjunction with a forced airflow between the heating elements and printed material being cured. A controller is employed which sends an electrical signal upon advancement of the printed materials. Full curing voltage with no forced airflow is supplied to the heating elements during curing operations, whereas a lower voltage in combination with forced airflow is employed during the intervals between successive curing operations to prevent heat from continuing to be imparted to the printed material while still allowing for rapid re-attainment of full curing upon resumption of production.

11 Claims, 3 Drawing Sheets

RESIN CURING APPARATUS AND METHOD UTILIZING INFRARED LAMP AND BLOWER CONTROL MEANS

This is a continuation of application Ser. No. 07/592,185, filed Oct. 3, 1990, now abandoned.

BACKGROUND OF THE INVENTION

1. Field of the Invention

This invention relates to an apparatus and method for drying or curing inks, and more particularly, to an apparatus and method for utilizing electrical resistance heating and directed airflow to dry or cure screen printed ink on a material such as a textile.

2. Description of Related Art

Conventional silk screen presses print multi-colored images on material by mounting the material to a platen and rotating the platen past each of a plurality of print units, located peripherally about a central support, wherein each print unit prints a different color. The images printed at the several print units, when superimposed one over the other on the material, produce the desired multi-colored work. It is important in multi-colored apparatus of this type to completely cure, or dry, the ink applied at a previous station prior to application of a differently colored ink at a subsequent station. Curing between successive ink applications is sometimes necessary or desirable in order to avoid smearing or blurring of the previously printed image upon printing of a subsequent image thereupon. It is known to utilize electrical resistance heating elements situated in proximity with the printed material, or workpiece, which impart radiative and convective heat to the printed material between successive printing operations sufficient to cure the print thereon. Since only a thin layer of ink is applied in silk screening applications, the required heat exposure time for curing is relatively short. Overheating of the printed work may result in wrinkles, discoloration, shrinkage, and/or scorching of both the applied ink and the underlying material. Therefore, it is important that the heat application be closely controlled.

Normally, only a thin layer of ink is applied in screen printing operations, and exposure to ambient air is sufficient to adequately cure or dry the applied ink. However, certain applications require a heavier layer of applied ink. For instance, before printing fluorescent ink upon a black material such as a T-shirt, it is necessary to apply a heavy layer of white ink to completely cover up the black substrate. Thus, curing is generally necessary immediately following such a white layer print unit at which the heavy layer of white ink is applied.

Ink may be cured at any number of different stations between different printing operations for various reasons. Therefore, it is desirable to provide a curing apparatus which is portable so that the apparatus can be inserted and removed at any desired printing station or open station about the screen press as desired to suit a given application. Thus, one or two portable curing apparatus may be located about the press as desired to suit a given application to perform the desired curing operations, instead of maintaining a multiplicity of stationary curing apparatus about the press and only employing one or two of these in any given application. Significant savings are realized by the ability to reduce the number of curing apparatus required. Therefore, there is a need for a portable curing apparatus for use with silk screen printing presses.

The heat generated by electrical resistance heaters increases with time upon application of a given voltage, so that the heating elements require time to reach their point of maximum heat emission. A particular problem with current designs is that they are not able to reconcile the conflicting goals of providing maximum heating during curing and interruption of heat to the printed material between curing operations, without significantly reducing production speed. Two alternative methods are employed in current curing apparatus. Either the heating elements are maintained at a constant high heating level so that no time is lost in bringing the heating elements back up to their maximum level, or else the voltage supplied to the heating elements is completely interrupted between curing operations and reapplied during curing. Both designs have been found to be inadequate. Maintaining the heating elements at high voltage has been found to cause high heat build-up, and if the apparatus is stopped from indexing the workpiece, a paper or textile workpiece can be subjected to sufficient heat to scorch or to catch fire. To prevent scorching or burning of the material when the indexing movement is stopped, the voltage may be interrupted. However, interruption of the voltage to the heating elements between curing operations is undesirable in that production speeds are limited by the time required for the heating elements to reattain their maximum heating level upon reapplication of electrical power thereto.

An example of apparatus wherein the heating elements are maintained at a constant heating level is the current shutter concept. This design employs a conventional shutter system positioned between the printed material and the heating elements to isolate the heating elements from the printed material at the completion of the desired curing time. Therein, a plurality of slats pivot simultaneously between an open position, wherein the slats are parallel one another so as to allow a generally free flow of heat and air therethrough, and a closed position, wherein the slats overlap one another to block the flow of heat therethrough. Only during production interruptions is the flow of electrical power to the heating elements interrupted.

As with other portable curing apparatus employing heating elements maintained at the high curing temperature, this design has been found to be undesirable in several respects. Since the function of the shutters is to block off the open face of the housing between curing operations to prevent heat from exiting therefrom, an undesirable accumulation of heat within the housing develops. This results in the overall apparatus, including the shutters, becoming hot. Thus, during production interruptions, wherein power to the heating elements is interrupted, the heated apparatus continues to impart undesirable heating to a printed material situated therebeneath. There is a need to prevent this residual heating.

Also, the aforementioned accumulation of heat, in combination with the high temperature produced by the heating elements, has been found to cause warping of the shutters. Such warping results in the inability of the shutters to effect an adequate seal between the heating elements and the workpiece, thereby allowing radiative and convective heat to be imparted to the printed material between curing operations. Warping of the shutters has also been found to cause malfunctions in the opening and closing thereof. Furthermore, the high temperature of the heating elements and heat accumulation has been found to cause excessive metal fatigue in nearly all movable components of the apparatus, which further contributes to an undue number of shutter malfunctions. Accordingly, it is desirable to provide a portable curing apparatus in which the heating elements are not maintained at a continual high temperature.

Likewise, curing apparatus in which the electrical supply to the heating elements is completely interrupted between curing operations have been found undesirable as well. While the heat accumulation problems associated with constant heating of the heating elements is minimized, the problem with such designs is that their production capacity is relatively slow. That is, since the heating elements require time to reattain the desired heating level for curing after each power interruption, the production rate is limited by this lag time. Since advances in press speeds are constantly being realized, it is desirable to provide a curing apparatus which does not require significant time to reheat the heating elements between each curing operation. For example, T-shirt screen printers may index the pallet holding the T-shirt every four to six seconds. Stopping of the indexes for 20 or 30 seconds to reattain the desired heating level will slow production.

Of additional importance in such apparatus is the ability to completely interrupt the application of heat to the printed material after the desired curing period. Current curing apparatus, and most particularly portable curing apparatus due to their minimized machinery, suffer in their inability to prevent residual heat from the apparatus from continuing to heat the printed material even after complete discontinuation of electrical flow to the heating elements. That is, the electrical resistance heating elements become heated to very high temperatures and require time to cool down, even after interruption of electrical power. Also, the electrical resistance heating elements employed to impart the desired heat for curing, heat not only the printed material, but also heat the apparatus supporting and housing the heating elements. After the desired curing time has elapsed, and the flow of electricity to the heating elements is interrupted, it is important to prevent the heated curing apparatus and heating elements from continuing to impart heat to the workpiece. Otherwise, accurate curing times are not attainable and overheating may result.

While it is possible to compensate, at least in part, for such residual heating wherein the apparatus is in continuous operation with printed materials regularly advanced, such residual heating is particularly problematical wherein it is necessary to interrupt production for any reason, thereby leaving printed material stationary beneath the curing apparatus. Generally, the length of such interruptions is unknown, and during such interruptions a printed material may be situated in proximity with the heated curing apparatus which will continue to impart convective heat to the printed material throughout the duration of the interruption. This uncontrolled residual heating precludes the aforementioned requisite heating accuracy.

Therefore, there is a need for a curing apparatus capable of imparting an accurately controlled amount of heat to a printed material, and thereafter preventing any residual heat of the apparatus from effecting the printed material. It is desirable to provide such an apparatus which does not employ mechanical means in proximity with the heating elements so that fatigue effects are minimized. Also, since curing apparatus are not necessary for many applications, it is desirable to provide such an apparatus which is portable, so that the apparatus can be relocated to any position about the printing press, or removed completely from the press, as required to suit a desired operation. It is also desirable to provide such apparatus wherein the height of the heating elements in relation to the printed material can be accurately and easily adjusted so as to provide flexibility to allow the apparatus to be utilized in conjunction with a wide variety of printing presses, and also allow for more accurate control of the amount of heat from the heating elements imparted to the printed material. Furthermore, it is desirable to provide such a curing apparatus which lends itself to economical manufacturing and operation.

SUMMARY OF THE INVENTION

In accordance with the present invention, there is provided a portable curing apparatus for use with a wide variety of screen printing presses, which provides medium wavelength infrared electrical resistance heating to a printed material or workpiece sufficient to rapidly cure the ink printed thereon while preventing residual heat from the apparatus from continuing to heat the printed material after the completion of the desired curing time. This provides the requisite accuracy in control of the time over which heat is imparted to the printed material for curing of printed material thereon prior to the workpiece undergoing a subsequent printing operation. Apparatus constructed in accordance with the present invention are particularly advantageous in situations wherein production is interrupted. The apparatus provides means for preventing any residual heat of the apparatus from continuing to heat the workpiece between curing operations. Furthermore, since no mechanical components are employed in proximity with the heating elements, apparatus constructed in accordance with the present invention have increased longevity and reduced repair necessity.

In accordance with one embodiment of the present invention, during the intervals between curing operations, the voltage supplied to the heating elements is dropped to a fraction of the curing voltage, and a thin layer of high velocity air is simultaneously blown between the heating elements and the workpiece. The airflow rate is sufficient to dissipate the low heat generated by the heating elements at the reduced voltage, and any residual heat from the heating elements and their housing, away from the workpiece. The airflow also increases convection at the workpiece surface, which further assists in the cooling thereof between curing operations.

That is, while a predetermined full voltage sufficient to effect curing is supplied to the heating elements during curing, the voltage is reduced to approximately one half to one quarter of full voltage between curing operations and during production interruptions and, during such periods of low voltage, air is blown between the apparatus and printed material. Upon a subsequent registration of a printed material beneath the curing apparatus, full voltage is resumed and the airflow discontinued.

The supplied voltage is alternated between high and low levels, and the blower turned on and off, based upon signals sent from a programmable control panel. The control panel is interconnected with each of several outlets with an outlet located at each printhead on the press, into which the curing apparatus are plugged.

Quartz tubes or similar electrical resistance heating elements are employed which allow operation under both partial and full voltages with the heat generated by the tubes proportional to the applied voltage. Both between curing operations and during periods of production interruption, a reduced voltage continues to be supplied to the heating elements. This allows the heating elements to reattain their maximum heating level more rapidly upon reimposition of full voltage than designs wherein the voltage to the heating elements is completely interrupted between curing operations. Accordingly, a greater number of materials can be cured in a given time by apparatus constructed in accordance with the present invention.

Also, the aforementioned heat accumulation problems associated with a continual electrical supply to the heating elements are eliminated in apparatus constructed according to the present invention. Since the entire face of the heating elements are exposed to ambient air with a stream of forced air passing thereover, the low level heat generated by the heating elements between curing operations and during production interruptions is dissipated away from the workpiece sufficiently to prevent the workpiece from being heated any significant amount.

The heating elements and blower are removably mounted on a caster supported stand which allows the apparatus to be wheeled into any desired position at which curing is required, and wheeled out of position as desired to suit a given application. The tube bed housing the heating elements, and the blower, may be made removable from the support stand, thereby allowing the panel to be placed in an accommodating screen printing frame provided on a press with the blower, free standing on the floor, in communication therewith. Thus, the support stand can then be wheeled away from the press, thereby allowing greater operator room for maneuvering about the press and also making any necessary repairs thereto.

A further advantage of apparatus constructed in accordance with the present invention is the elimination of mechanical elements. By employing a stream of air instead of shutters, the aforementioned problems associated with warping are eliminated. Also, since there are no movable parts in proximity to the heating elements, fatigue is not a critical factor in the efficiency of operation of the apparatus, as was the case with previous designs.

While large, stationary curing devices can employ complex cooling arrangements, portable units are limited in the machinery they support by the need to maintain mobility. Apparatus constructed in accordance with the present invention, provide the requisite heating interruption in a portable unit. Thus, apparatus constructed in accordance with the present invention lend themselves to more simple and economical fabrication than previous curing apparatus.

This invention will be more fully understood and further objects and advantages thereof will become apparent in the following detailed description of preferred embodiments of the invention illustrated in the accompanying drawings.

BRIEF DESCRIPTION OF THE DRAWINGS

Wherein like elements are referenced alike.

DETAILED DESCRIPTION OF THE PREFERRED EMBODIMENTS

Figure 1:
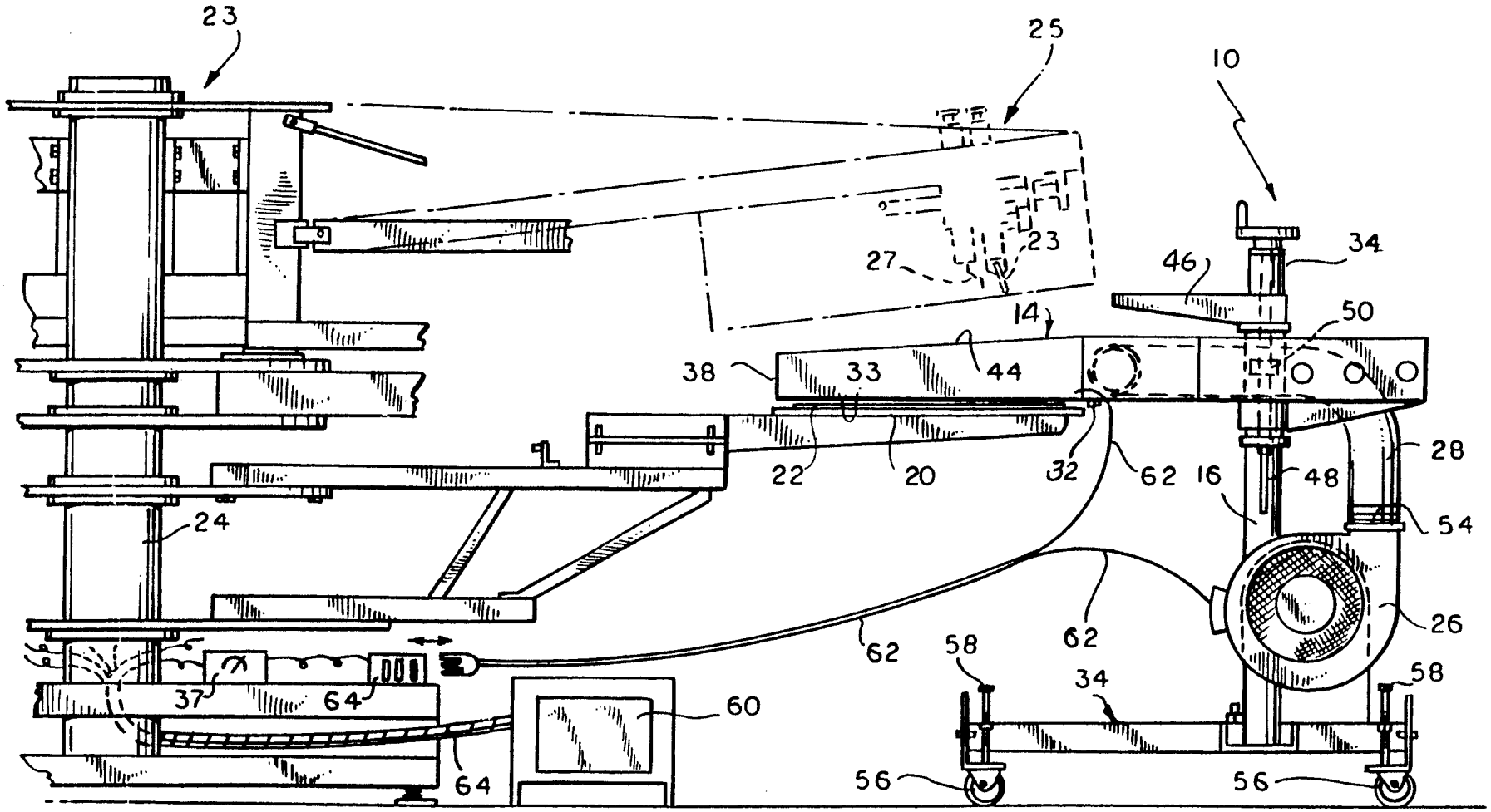
FIG. 1 is an illustration of an embodiment of a curing apparatus constructed in accordance with the present invention, shown positioned above a printed material which is carried upon rotary platens.
Figure 2:
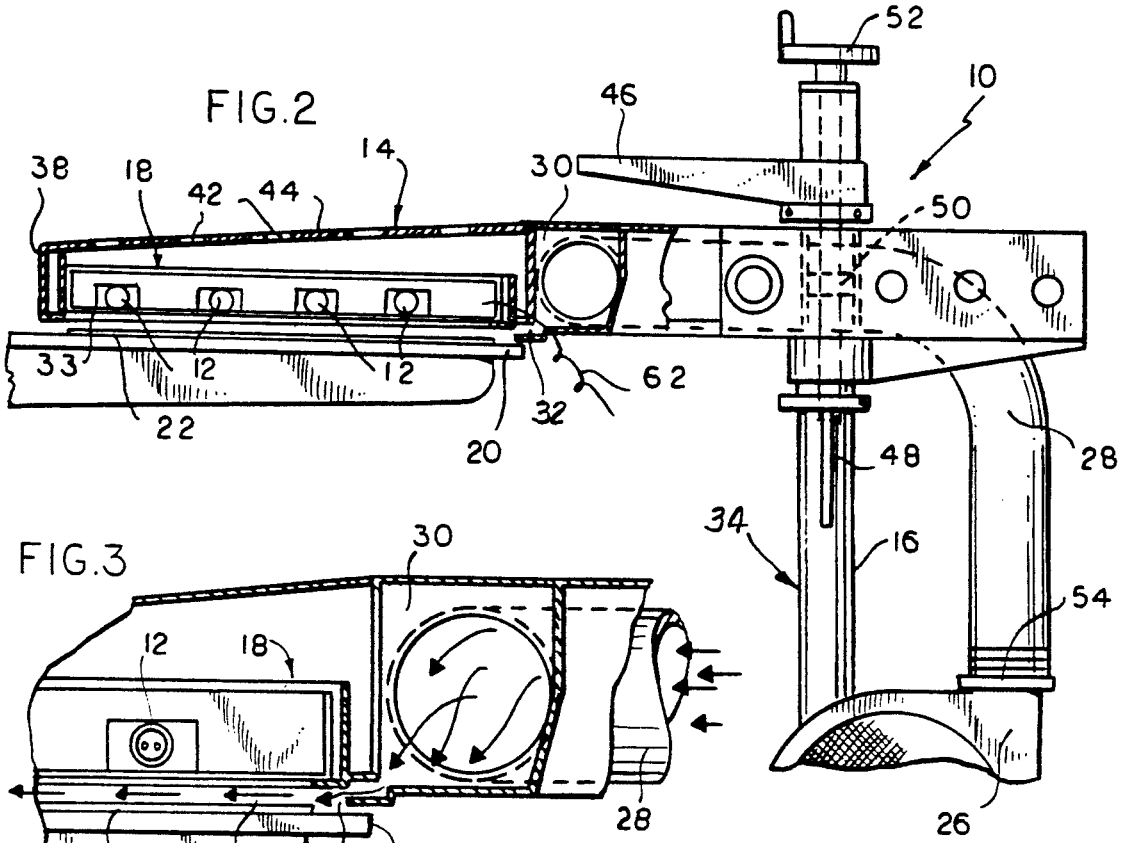
FIG. 2 is an enlarged, cross sectional view of the upper portion of the embodiment of FIG. 1.

FIGS. 1-5 show preferred embodiments of a curing apparatus constructed according to principles of the present invention. The overall apparatus is designated generally at 10. As best seen in FIG. 2, a plurality of quartz tubes 12, which are electrical resistance heating elements, are supported by a generally horizontal arm 14 which is, in turn, supported upon a vertical column 16. The plurality of quartz tubes 12 are located in a tube bed 18 which is removably attached to the horizontal arm 14 at a point distant from the vertical column 16. The arm 14 and tubes 12 are spaced above a platen 20 and workpiece or material 22 which pass below the tubes. The arm 14 is cantilevered over the platen and this allows the rotary platens 20, upon which material 22 to be printed is conventionally mounted, to sequentially pass beneath the tube bed 18 without contacting the vertical column 16. (see FIG. 1)

In conventional screen presses 23, a plurality of platens 20 rotate about a central column 24 and sequentially carry the material 22 mounted thereon into registration with printing heads 25 including a squeegee 23 and flood bar 27, the printing heads being located peripherally about the central column 24. The tube bed 18 portion of the apparatus 10 is positioned so as to also be in registration with one of the platens 20 when the platens are at rest and the printing heads 25 are positioned to print at the other stations where no curing apparatus is present. Thus, the apparatus 10 cures the material 22 after it has been printed upon at a preceding station and is rotated into registration at an open, non-printing station at which is located the tube bed 18 portion of the apparatus. That is, while the several materials in registration with their respective printing units are undergoing printing operations, the printed material in registration with the curing apparatus 10 is simultaneously undergoing curing.

Curing is attained by supplying electric power to the quartz tube heating elements 12 while the printed material is situated therebeneath, which causes the tubes to become hot and impart heat to the printed material 22 to effect curing. The maximum temperature which the quartz tubes 12 will reach varies in proportion to the voltage supplied thereto. The voltage applied to the tubes 12 is variable, and the optimal voltage to be supplied will vary depending upon the specific application. In most applications, however, the voltage supplied during curing is the maximum possible for the type of quartz tube 12 employed. This results in the greatest possible heating during curing, which therefore provides the most rapid curing time attainable. Thus, after a material 22 has been printed upon, and advanced to a position beneath the extending tube bed 18, a predetermined electrical power is supplied to the tubes 12 for a period sufficient to effect curing of the printed material.

This cure time will vary dependent upon the heating capability of the quartz tubes 12 employed, the selected voltage, the materials being cured and other parameters particular to the application at hand.

However, in certain situations, it is not desirable to provide the maximum possible heating during curing. In such situations wherein a curing voltage less than the maximum possible voltage is to be employed during curing operations, such as for heat sensitive materials, full voltage is supplied to the heating elements 12 until the desired heating level is attained and thereafter the voltage is lowered to the desired reduced heating level. Normally, this reduced curing level is only slightly less than the maximum level. The heating elements 12 heat up more quickly with higher voltages than with lower voltages. After the heating elements 12 have been at low voltage between curings and during production interruptions, it is desired to bring the heating elements up to the desired higher heating level for curing as quickly as possible. By supplying a higher voltage to the heating elements 12 initially, until the desired heating level is attained, the heating elements can be brought to the desired heating level for curing more quickly than designs in which less than the maximum voltage is supplied initially.

At the completion of the desired curing time, the voltage supplied to the quartz tubes 12 is reduced to a fraction of the full voltage. The reduced voltage is generally between about one quarter to one half of the maximum voltage, although reduced voltages outside this range may be desirable for certain applications.

Simultaneous with the voltage drop to the tubes 12, the blower 26 is actuated to induce a flow of air between the tube bed 18 and the printed material 22. Conduit 28 extends from the blower 26 to the plenum portion 30 of the horizontal arm 14. A slotted opening 32 is provided in the plenum portion 30 through which the air from the blower 28 can exit the plenum 30 as a thin sheet of high velocity airflow. The slot 32 is configured so as to direct the airflow generally along the underside 33 of the tube bed 18, whereby the air passes between the apparatus 10 and the printed material 22, generally parallel to the underside 33 of the tube bed 18. With the quartz tubes 12 at a reduced voltage, and, therefore, a reduced heating level, the sheet of high velocity air passing between the tube bed 18 and the printed material 22 is sufficient to prevent significant further heat transfer to the printed material. Accordingly, between successive curing operations, and during periods of production interruption, the aforementioned problems associated with continued heating of the printed material 22 during these periods is eliminated, regardless of the duration of such periods. Also, since the voltage supplied to the quartz tubes 12 is not entirely cut off between successive curing operations, less time is required to bring the quartz tubes 12 back to their maximum heat level upon reapplication of full voltage thereto. This allows complete curing of successive printed materials 22 at a faster rate than previous designs.

In accordance with one embodiment of the present invention, the tube bed 18 and blower 26 are mounted on a caster supported portable stand 34. This allows the apparatus 10 to be wheeled to any desired location about a screen press 23 as desired to suit a given application. Normally, the curing apparatus 10 will be placed at a location formerly occupied by a printing head, which head has been lifted out of position (see phantom lines in FIG. 1). Thus, after a printing head 25, including the squeegee 23, flood bar 27 and silk screen 29, is lifted upwards, the tube bed portion 18 of the apparatus 10 is inserted underneath the printing head 25. Thus, as the platens 20 come to rest with the plurality of printing heads printing upon the respective materials 22 therebeneath, one of the platens 20 supporting printed material 22 will be beneath the cantilevered tube bed 18. Accordingly, while the printing heads are printing upon the material thereat, the curing apparatus 10 cures the printed material thereat.

In the majority of screen printing applications, it is sufficient for the ink to be applied thinly. With such a thin layer of ink, drying thereof is attainable merely by exposure to ambient air for a short time. However, for heavier paint applications, a separate curing apparatus is required to dry the printed material prior to a subsequent printing thereupon. Normally, the printing head is removed, and the curing apparatus 10 inserted, at the printing station immediately following a station at which the heavy layer of ink is applied. One example of where heavier ink applications are required is the application of white ink upon a black material prior to applications of fluorescent ink at subsequent printing stations. A heavy layer of ink is required in such applications to completely cover the substrate. Accordingly, the following station to which the printed material 22 is subsequently transported will have a curing apparatus 10 inserted thereat to cure the printed material prior to its being moved to a subsequent station at which it will undergo an additional printing operation.

The tube bed 18 comprises an outer housing 36 which supports a plurality of generally parallel quartz tubes 12 at their ends. Electrical power supplied to the tubes 12 causes the tubes to become heated, with the amount of heat generation proportional to the voltage supplied.

Actuation of the quartz tubes 12 and blower 26 is controlled by a control panel 60 of the type well known in the art which can alternatively supply a selected high voltage and a selected lower voltage to the tubes. These voltages are variable by adjustment of the control panel. Also, the control panel 60 is programmable so that, for instance, a very high voltage can be supplied to the quartz tubes 12 initially to rapidly heat the tubes with a slightly reduced voltage supplied after attainment of the desired curing temperature.

The control panel 60 is operated by electrical signals from the press which are sent to the control panel upon rotation of the platens 20, such that the voltage to the tubes 12 is increased, and the blower 26 turned off, upon registration of each successive printed material 22 beneath the curing apparatus 10; and the voltage to the tubes 12 decreased, and the blower 26 turned on, at the completion of a predetermined curing time. A safety time limit switch 37 is employed to return the apparatus 10 to its low voltage mode after the apparatus has been in its high voltage mode for a predetermined maximum time without receipt of a signal from the press 23 to the control panel 60. The time limit switch 37 may be mounted on the press 23, as shown in FIG. 1, or incorporated into the control panel. Thus, during periods of production interruption, the platens 20 are stationary, so no control signals are sent from the press 23 to the control panel, and the apparatus 10 continues to dwell in low voltage mode, with the blower 26 turned on, until production is resumed. Upon resumption of production, a signal is sent by the press to the control panel 60 upon registration of the platens 20 to return the apparatus to its high voltage mode. Electrical power from the control panel is supplied to the quartz tubes 12 and blower 26 through conventional wiring 62 extending therebetween. The control panel 60 is connected to each of a plurality of outlets 64, each located at a respective printing head. This allows the apparatus to be simply plugged into the desired outlet 64 at which the apparatus is positioned and be controlled by the control panel 60 as programmed. This eliminates the need for extensive wiring from the wall to each apparatus. The ability to program the control panel 60 allows for automatic actuation of the various curing apparatus constructed in accordance with the present invention regardless of how many units are connected and regardless of the position at which they are located.

As seen in FIG. 2, the tube bed 18 is removably mounted near the free end 38 of the cantilevered horizontal arm 14, and it extends out over the platens 20 rotating therebeneath. Removability of the tube bed 18 is desirable to allow for replacement of individual quartz tubes 12 therein, or replacement of the entire tube bed 18 as a whole, as may be required due to the continual thermal cycling which the tubes must undergo. This thermal cycling also causes repeated expansion of the air surrounding the tube bed 18. The underside of the horizontal arm 14 is provided with an opening which extends from the free end 38 of the horizontal arm 14 to the plenum portion 30, and across the width of the tube bed 18 as well. This opening allows unimpeded heat flow from the underside 33 of the tube bed 18 to the printed material 22. To prevent pressure build-up associated with the aforementioned air expansion and heat accumulation in the region above the tube bed 18, vents 42 may be provided in the upper surface 44 of the horizontal arm 14 to allow ventilation therethrough.

As discussed previously, the blower 26 is turned on simultaneous with a reduction in the voltage supplied to the quartz tubes 12 during periods in which no curing is desired, such as between successive curing operations and during production interruptions. During such periods, the voltage supplied to the quartz tubes 12 is reduced so that only low level heat is generated therefrom. The forced air from the blower 26 is passed between the apparatus 10 and the printed material 22 to prevent the low level heat which continues to be generated by the quartz tubes 12 from affecting the printed material.

Figure 3:
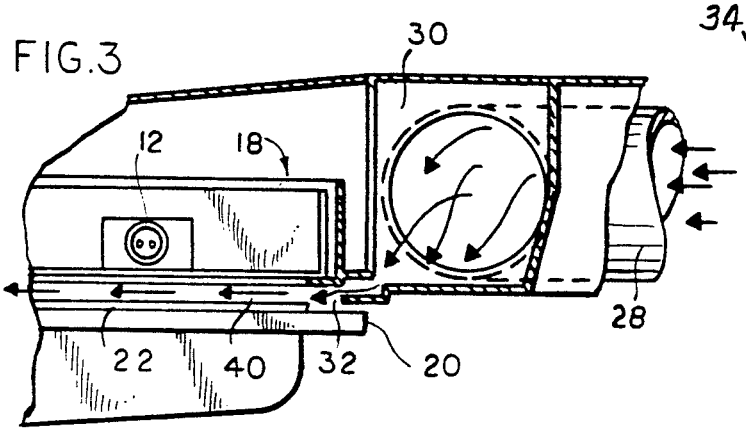
FIG. 3 is an enlarged, fragmentary view of the plenum portion of the view of FIG. 2, particularly illustrating the path of airflow.
Figure 4:
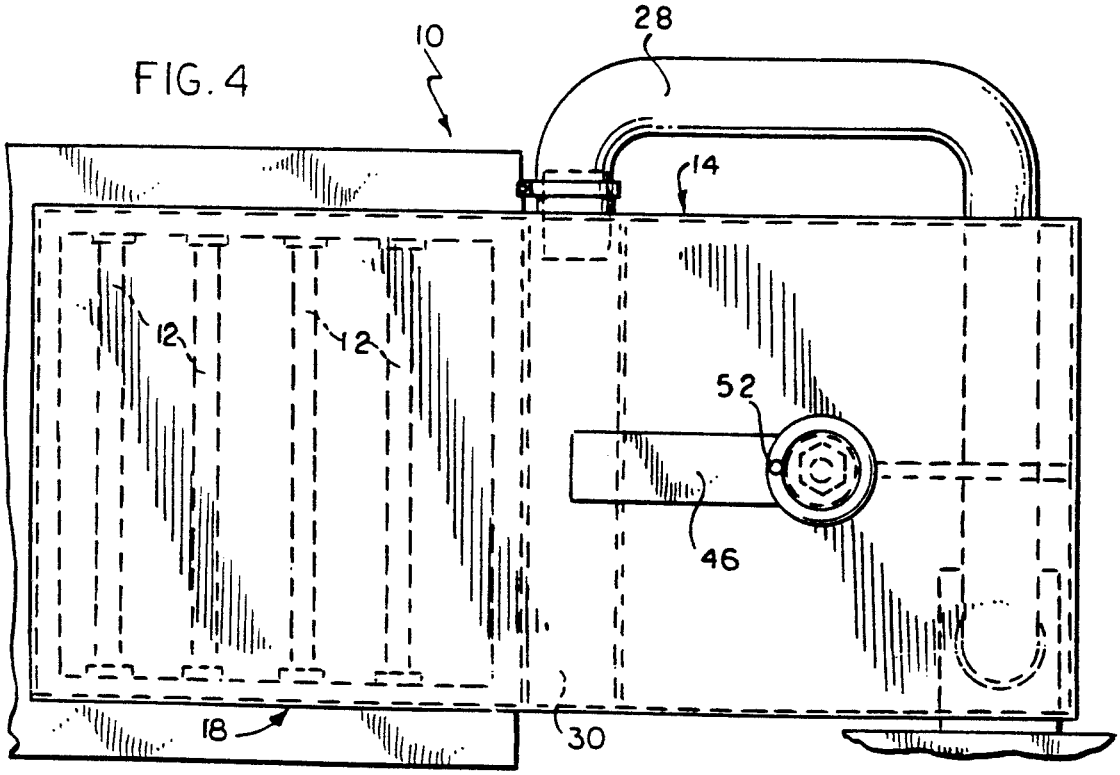
FIG. 4 is an enlarged top view of the embodiment of FIG. 1
Figure 5:
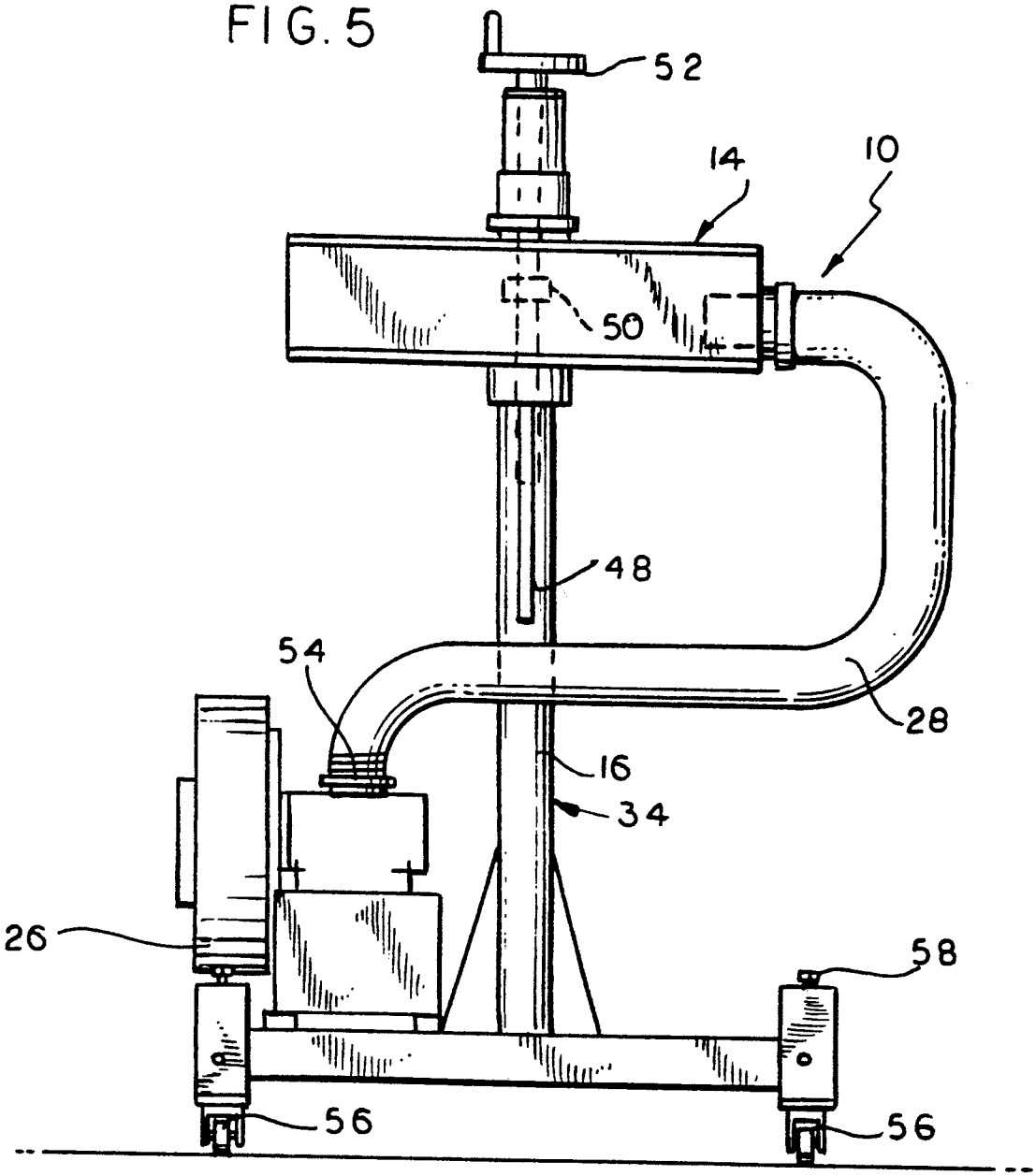
FIG. 5 is an enlarged rear view of the embodiment of FIG. 1.

Conduit 28 extends from the outlet 54 of the blower 26 into the plenum portion 30 of the horizontal arm 14. As best seen in FIG. 3, the plenum 30 is provided with an elongated slotted opening 32 through which the pressurized air in the plenum 30 exits therefrom as a thin sheet of high velocity air. The slotted opening 32 is configured so as to direct the sheet of high velocity air between the tube bed 18 and the printed material. Various configurations of slotted openings 32 are suitable to achieve this.

As stated above, the desired voltage to be supplied to the quartz tubes 12 will vary depending upon the specific heat required to attain curing in a given application. Further flexibility in control over the amount of heat imparted to the printed material 22 is attainable by varying the distance between the tube bed 18 and the printed material 22. Accordingly, the horizontal arm 14 on which the tube bed 18 is supported is provided with means for adjusting the height thereof. In addition to allowing variation of the distance between the tube bed 18 and printed material 22, the height adjustment capability also allows the apparatus 10 to be used in conjunction with a wide variety of screen presses 23 having differing platen heights.

To allow for adjustments in the height of the tube bed 18, the horizontal arm 14 is provided with an aperture therein through which the vertical column 16 extends to support the horizontal arm 14 thereupon in a cantilevered fashion. The horizontal arm 14 can thus move up and down the vertical column 16 to the desired height. Since the apparatus 10 may become heated, a handle 46 is provided by which an operator can simply grip the handle 46 to position the tube bed 18 to the desired position above the platens 20. After the apparatus 10 has been placed into position, the height of the tube bed 18 in relation to the printed material 22 situated therebeneath can be adjusted. A threaded pin 48 extends into a complementary threaded nut 50 which is affixed to the horizontal arm 14, so that adjustments in the height of the horizontal arm 14 are thereby attainable by rotation of the threaded pin 48. A pin handle 52 is provided atop the threaded pin 48 to allow for easier rotation of the threaded pin 48 by an operator without the use of additional tools. Thus, the horizontal arm 14, and, therefore, the tube bed is maintained at a desired height and accurately adjusted by interaction of the threaded pin 48 within the nut 50.

The support stand 34 is mounted upon retractable casters 56 to allow for easy repositioning of the apparatus 10. After the apparatus 10 has been moved into the desired position about the press 23, the casters 56 are retracted upward, until they are higher than the adjustable legs 58. The casters 56 may be interconnected by a wormgear arrangement or other suitable arrangement so that all the casters are elevated simultaneously by the turning of a single handle. With the casters 56 elevated higher than the legs 58, the stand 34 will then be supported upon the four adjustable legs 58 rather than the casters 56. This prevents the apparatus 10 from moving about during production. The four legs 58 are independently adjustable to allow for leveling of the tube bed 18 portion of the apparatus 10 regardless of the unevenness of the plant floor on which the stand 34 rests.

The support stand 34 may also be provided with a registration pin or similar component which is received into a complementary registration component on the press to provide quick, accurate positioning of the apparatus. While the invention has been described with reference to a preferred embodiment, it will be understood to those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for screen printing ink and for curing ink on a workpiece, comprising:

a screen printer having a plurality of work piece platens rotatable about a central axis and having print heads at some stations for printing ink on the workpiece, a portable curing means to be positioned in and removed from a position overlying a platen to cure previously printed ink, a frame for said curing means;

heating means mounted to said frame for projecting laterally over a platen rotatable therebeneath and positionable in proximity with said workpiece for imparting heat thereto to effect curing thereof;

electrical signal means for sending an electrical signal with respect to the positioning of said workpiece beneath said heating means;

voltage control means associated with said curing means for selectively supplying high voltage and a lower voltage to said heating means corresponding to said electrical signal received from said electrical signal means;

blower means on said curing means for selectively supplying and interrupting a flow of forced air between said heating means and said workpiece so as to prevent heat from said heating means from significantly heating said workpiece during periods during which said lower voltage is supplied to said heating means; and blower control means for switching said blower means to supply and interrupt said forced air corresponding to said electrical signal received from said electrical signal means.

2. An apparatus, in accordance with claim 1, wherein said heating means is a low wavelength infrared heat source.

3. An apparatus, in accordance with claim 1, wherein each of said voltage control means and blower control means are controlled through a programmable control panel.

4. An apparatus, in accordance with claim 1, wherein said frame is mounted upon wheel means for providing portability to the apparatus whereby the apparatus may be wheeled to any desired location.

5. An apparatus, in accordance with claim 1, wherein said heating means is mounted on a horizontal arm, the height of which is adjustable upon the frame.

6. An apparatus, in accordance with claim 1, wherein said blower means includes a slotted opening to direct a sheet of air between the heating means and the workpiece.

7. An apparatus, in accordance with claim 1, further including a safety limit switching means for switching said blower means to its air supplying position, and said voltage control means to its lower supplying position after passage of a predetermined time in the absence of receipt of an electrical signal from said electrical signal means.

8. An apparatus, in accordance with claim 1, wherein said apparatus is used for curing paint applied to a substrate on a silk screen printing press.

9. An apparatus, in accordance with claim 8, wherein a plurality of said apparatus are employed simultaneously at respective positions about a common screen printing press.

10. An electrical resistance, portable curing apparatus for curing screen printed ink on a material applied by screen printing apparatus having a rotatable platen for moving an inked workpiece from a printing station to an adjacent curing state, comprising:

a movable frame for movement into a position over a platen;

electrical resistance heating means mounted to said frame and movable thereby into proximity with said printed material, for imparting heat to said printed ink to effect curing thereof;

control means for controlling the voltage supplied to said electrical resistance heating means such that a first, predetermined high voltage is supplied during periods in which curing is to be effected and a second, predetermined lower voltage is supplied during periods after curing of the ink at the curing station and when the platen fails to move from the curing station within a predetermined period of time;

blower means for selectively supplying and interrupting a flow of forced air between said heating means and said printed material, whereby airflow is interrupted during the high voltage periods wherein curing is to be effected, and a flow of forced air is supplied during the lower voltage periods, so as to prevent heat from said apparatus from significantly heating said screen printed material during said lower voltage period after curing of the ink.

11. A method for curing screen printed ink on material, comprising:

providing material on platens of a rotatable screen printer having platens rotatable between a screen printing station at which ink is printed on the material and a curing station at which the ink is to be cured, moving a portable curing means having a heat source thereon into the curing station from a location remote from the screen printer;

placing the heat source in proximity with said screen printed ink on the material;

heating said heat source to a predetermined heat level for a predetermined period to cure said ink on said material;

reducing said heat level at the completion of said predetermined curing period;

blowing air between said heating source and said printed material during the period of reduced heat level to prevent further heating of the material at the curing station until the next platen brings a new printed material into the curing station.

* * * * *

UNITED STATES PATENT AND TRADEMARK OFFICE

CERTIFICATE OF CORRECTION

PATENT NO. : 5,228,108

DATED : July 13, 1993

INVENTOR(S) : Motev, et al.

It is certified that error appears in the above-identified patent and that said Letters Patent is hereby corrected as shown below:

ON THE TITLE PAGE:

Change "Fitchh" to --Fitch--.

Column 2, line 39, after "parallel" insert --to--.

Column 6, line 9, after "FIG. 1" insert --;-- (semicolon).

Column 12, line 9, change "state" to --station--.

Signed and Sealed this

Eighth Day of March, 1994

Bruce Lehman

*Attest:*

BRUCE LEHMAN

*Attesting Officer*

*Commissioner of Patents and Trademarks*